United States Patent [19]

Lamport et al.

[11] Patent Number: 4,737,690

[45] Date of Patent: Apr. 12, 1988

[54] DISPLAY TUBE

[75] Inventors: Daphne I. Lamport; Alfred W. Woodhead, both of Caterham, England

[73] Assignee: U.S. Philips Corporation, New York, N.Y.

[21] Appl. No.: 830,388

[22] Filed: Feb. 14, 1986

Related U.S. Application Data

[63] Continuation-in-part of Ser. No. 767,658,, Aug. 19, 1985, which is a continuation of Ser. No. 437,388, Oct. 28, 1982, which is a continuation-in-part of Ser. No. 393,210, Jun. 28, 1982.

[30] Foreign Application Priority Data

Jul. 8, 1981 [GB] United Kingdom ..... 8121036

[51] Int. Cl.[4] ..... H01J 29/70; H01J 29/72

[52] U.S. Cl. ..... 315/366; 313/422

[58] Field of Search ..... 315/366, 366 APS; 313/422, 103 CM, 105 CM

[56] References Cited

U.S. PATENT DOCUMENTS 2,982,875 5/1961 Gabor ..... 315/366

4,137,486 1/1979 Schwartz ..... 315/366

4,511,822 4/1985 Washington et al. ..... 313/105 CM 4,577,133 3/1986 Wilson ..... 313/422

*Primary Examiner*—Theodore M. Blum

*Assistant Examiner*—Gregory C. Issing

*Attorney, Agent, or Firm*—Robert J. Kraus

[57] ABSTRACT

A flat display tube comprising an envelope including a faceplate on which a luminescent screen is provided. An internal divider divides the interior of the envelope vertically into a front portion adjoining the faceplate and a rear portion which communicates with the front portion via a space between the upper edge of the divider and a peripheral wall of the envelope. An upwardly directed electron gun and line scanning means are disposed in the rear portion. The line deflected electron beam is directed to a 180° reversing lens which deflects the electron beam into the front portion. An electron multiplier is disposed in the front portion adjacent to, but spaced from, the faceplate. The electron beam in the front portion undergoes frame deflection by means of a plurality of selectively energized, vertically spaced, horizontally elongate electrodes. The pattern of energization of the electrodes is such as to deflect an end portion of the electron beam to the input side of the electron multiplier. The beam having undergone electron multiplication is accelerated to the screen.

13 Claims, 2 Drawing Sheets

DISPLAY TUBE

CROSS-REFERENCES TO RELATED APPLICATIONS

Continuation-in-part application of U.S. application Ser. No. 767,658 filed Aug. 19, 1985, which is a continuation of U.S. application Ser. No. 437,388 filed Oct. 28 1982, which a continuation-in-part of U.S. application Ser. No. 393,210 filed June 28, 1982.

FIELD OF THE INVENTION

The present invention relates to a display tube, more particularly to what may be termed a flat display tube in which an electron beam is directed along a path parallel to a planar screen, is turned through 180° so that it travels in the opposite direction and is subsequently deflected towards the screen.

DESCRIPTION OF THE PRIOR ART

There have been many proposals for the design of a flat display tube but so far there has been no widespread manufacture and use of such a tube.

One early researcher in this field was D. Gabor who published his proposed ideas over a number of years and reference may be made by way of example to British Patent Specification No. 739,496 (NRDC); Paper No. 2661R read before the Radio and Telecommunication Section of The Institution of Electrical Engineers, London May 1958, by D. Gabor, P. R. Stuart and P. G. Kalman; and Proc. IEE., Vol. 115, No. 4, April 1968 pages 467 and 478 "A fully electrostatic, flat, thin television tube" by D. Gabor, H. A. W. Tothill and Joyce E. Smith-Whittington. FIGS. 4 to 8 of British Patent Specification No. 739,496 disclose a flat display tube in which an electron beam is produced and is directed along a first path which is substantially parallel to a screen. Whilst in the first path the electron beam undergoes line deflection. The electron beam is then reflected by 180° using a reversing lens so that the electron beam is directed along a second path which is between, and substantially parallel to, the first path and the screen. Whilst in the second path the electron beam undergoes frame deflection during which it is turned to impinge on the screen. Frame deflection is achieved by two sets of interconnected electrodes, one set on an insulating separator disposed between the first and second paths and the other set on the screen. Corresponding interconnected electrodes of each set are staggered in height relative to each other. A special valve is provided whereby during the frame flyback period all the electrodes are charged and then are selectively discharged during the frame scan period. Various refinements are proposed for producing pictures in colour.

In the above mentioned paper No. 2661R Gabor discloses a number of modifications to the basic tube described in British Patent Specification No. 739,496. One of these modifications concerns the reversing lens which is fabricated to increase the divergence angle of the fan (that is the angle swept out by the electron beam during line scanning) by a factor of about 4. This means that on leaving the reversing lens on the second path, the line deflected electron beam sweeps laterally through an angle of about 120° thus sweeping the horizontal width of the picture. This lateral sweep is then arrested by a collimating lens before the electron beam is deflected onto the screen. In another of these modifications the scanning array of thin linear conductors is charged and discharged by the electron beam itself and thus becomes self-scanning. Gabor admits that these modifications significantly increase the complexity of the tube construction.

In the PROC. IEE. article mentioned above there are disclosed some modifications to the previously mentioned display tube to simplify its construction. The complex reversing and collimating lenses are replaced by a simple trough-like reversing lens. However in order to be able to scan the screen across its entire width, the electron beam during its first path undergoes wide angled (±60°) deflection, is accelerated and then is collimated so that the electron beam approaches and leaves the reversing lens substantially normal thereto. The scanning array is modified so that it comprises fewer electrodes and rundown and flyback channels at opposite edges, each channel having its own electron gun. In spite of all these proposals spanning 16 years, no prototype tube was ever built.

Another researcher in the field of flat display tubes is W. R. Aiken and a small number of continuously pumped and sealed display tubes were produced for evaluation. From the point of view of the present invention the type of tube produced and disclosed in the Proceedings of the IRE, December 1957 pages 1599 to 1604 "A Thin Cathode-Ray Tube" is of less interest because a low voltage electron beam (800 V) is injected parallel to one edge of a flat tube and is deflected for a first time into the region between the front and back tube surfaces, whereafter it is deflected for a second time to turn it into the phosphor-coated front surface. After undergoing the first deflection the electron beam is accelerated to the screen potential (say 12 kV). Ideally, each of these deflections should be orthogonal. In reality though they are of the order of 45°. This can be deduced from the fact that the beam which emerges from the first deflection will have roughly equal velocity components in the horizontal and vertical directions. When the beam is accelerated to the potential of the screen this has the effect of increasing the vertical velocity component nearly 8 times without affecting the horizontal velocity component. Thus the angle of the beam path in this region is about 80°. A practical effect of this is that in order to deflect the electron beam to the side of the screen nearest the electron gun, the electron gun has to be offset from the screen by a distance which will allow the electron beam to scan the edge of the screen nearest the electron gun and in consequence the envelope/face plate area has to be much greater than the area of the screen because one has to allow room for the electron beam to be deflected and execute a frame scan of the screen. Consequently the display tube is undesirably bulky.

However in U.S. Pat. No. 2,837,691 Aiken proposes a flat display tube wherein an electron beam undergoes line deflection as it passes along a first path behind and parallel to a screen, the beam is turned through 180° and passes along a second path parallel to the first one through a space between the screen and a plurality of vertically spaced, horizontally elongate electrodes which are energized selectively to deflect the electron beam onto the screen. During the first path the electron beam has low energy but in the second path it is accelerated to a final energy of 10 keV. This difference in energies is essential because Aiken uses a semi-circular reflector electrode. If the energies in the first and second paths were made the same then as the electron beam leaves the reflector electrode it will focus and diverge. In consequence the electron beam would be unmanageable and could not be used for displaying an image spatially correctly. In contrast by having a high energy electron beam in the second path then undesirably high voltages are necessary to scan the electron beam in the frame direction and to deflect it onto the screen.

Another proposal for a flat display tube is disclosed in FIGS. 4 and 5 of British Patent Specification No. 865,667. The invention of this specification relates to the fact that if an electron beam is injected into a repelling electric field between two parallel planar electrodes then it will follow a parabolic path landing on the planar electrode through which the electron beam was injected, at the same angle as the angle of injection. In order to use this principle in a flat tube it is necessary to make the electron beam enter a space between the flat faceplate which has an optically transparent electrode thereon and a parallel arranged repelling electrode, as near as possible to the faceplate. This is done by producing a 15 keV electron beam which undergoes wide angled line deflection and is directed towards a part-toroidal conductive electron mirror which (1) bends the electron beam through 200°, (2) displaces the beam from a rearward field free space towards a luminescent target on the faceplate and (3) renders all the trajectory planes of the reflected beam paths parallel. By varying the voltage applied to the repelling electrode at frame frequency, the faceplate electrode being held at a constant voltage, the electron beam can be made to carry out a raster scan.

In spite of all the effort which has been expended in trying to develop a flat display tube, no tube is available. It is thought that this lack of success is due to a number of reasons, namely (1) that the tubes used electron beams of high energy and in consequence high voltage switching was required to achieve proper deflection, (2) in the case of colour tubes no satisfactory method of colour selection was demonstrated, (3) some of the prior proposals are technically complicated and/or any display tubes if produced would have had an unfavourable screen area to faceplate area ratio, and (4) in other proposals the electron beam undergoes wide angle deflection which leads to deflection aberrations requiring dynamic correction.

An object of the present invention is to overcome the above-mentioned problems in a flat display tube.

SUMMARY OF THE INVENTION

According to the present invention there is provided a display tube comprising an envelope including a faceplate on which a screen is provided, and within the envelope, an internal partition spaced from, and arranged substantially parallel to, the faceplate, the internal partition dividing the envelope into a front portion adjoining the faceplate and a rear portion which communicates with the front portion at one end of the envelope, means in the rear portion for producing a low energy electron beam which is directed towards said one end, means in the rear portion for deflecting the electron beam in one dimension in a plane substantially parallel to the screen, means for producing an electrostatic field in the rear portion, a reversing lens at said one end for deflecting the electron beam into the front portion, an electron multiplier disposed in the front portion substantially parallel to, but spaced from, the faceplate, a post deflection acceleration electrode on the screen, which electrode in use provides an accelerating electrostatic field between an output of the electron multiplier and the screen, and an electrode array on the front portion side of the internal partition, the electrode array in use being arranged to set up an electrostatic field having a component normal to the screen and adapted to deflect said low energy beam in another dimension towards the input side of the electron multiplier.

In the present specification by a "low energy" electron beam is meant an electron beam having an energy substantially lower than its energy on impact with the screen.

An advantage of using an electron multiplier, such as a channel plate multiplier comprising a laminated stack of dynodes, is that the deflection of the low energy beam can be carried out with relatively small electrostatic or magnetic fields which require only low voltage or low current switching, the final acceleration of the beam to produce the desired mean brightness taking place after the beam has been current multiplied. Such an arrangement enables the operation of the display tube to be treated in a modular fashion so that for example the electron beam addressing can be divorced from colour selection which takes place between the output of the electron multiplier and the screen.

In FIG. 8 of British Patent Specification No. 1,402,547 there is a suggestion of using an electron multiplier in the type of Aiken display tube disclosed in the above-mentioned Proceedings of the IRE, Dec. 1957 pages 1599 to 1604. Not only is such a display tube different in its construction from that of the present invention but also it would suffer from a number of disadvantages. Because lower voltage addressing is generally used with a current multiplier then in an Aiken display tube in which the beam is accelerated to screen potential (typically 12 kV) after the first deflection, the beam would have too high a voltage to be addressed using low voltages.

Now, if the Aiken tube is operated at low voltages such that the electron beam is at 100 eV and the screen potential is at 1.2 kV, substantially the same considerations would apply as mentioned above leading to a useful screen area of about 50% of the faceplate area which is undesirable for a so-called compact display tube. Another drawback is that it is difficult to transport a 100 eV electron beam because of the magnetic effects of the earth's field on the electron beam. Thus even if a channel plate electron multiplier is fitted in such a display tube as suggested in FIG. 8 of British Patent Specification No. 1,402,547, such a tube would have the disadvantages of only about 50% of the faceplate area would be useful and additionally the low-energy electron beam would be difficult to handle. Furthermore, it is anticipated that a large number of dynamic corrections would be necessary because of the beam following a second path which is inclined relative to the edge of the screen. There would also be problems in obtaining an adequately small spot size because a low-voltage electron beam would also have to be a low-current one to avoid the electron beam blowing-up due to space charge effects. Additionally, because the beam would have to be accelerated to 1.2 keV, then the frame scanning has to be carried out at 1 kV which is still higher than is desirable. Consequently this suggestion in FIG. 8 of Specification No. 1,402,547 would not lead to a practical display tube.

In an embodiment of the invention the reversing lens comprises a repeller electrode mounted at the one end of the envelope and a cooperating electrode on the internal partition. The repeller electrode is disposed symmetrically with respect to the internal partition and comprises a channel shaped member with flat sides and square or rounded corners. Contrary to general expectations a channel shaped member provides a better shaped lens field than a curved member. In order to correct for any asymmetry in the positioning of the reversing lens, for example due to the repeller electrode not disposed symmetrically with respect to the internal partition, a correction electrode is provided on the front portion of the internal partition adjacent the one end of the envelope.

The electrode array comprises a plurality of elongate electrodes arranged on the internal partition in a direction transverse to the path of the electron beam. If desired the elongate electrodes may be bowed by an amount sufficient to counter the effect of the variation in the forward component of the velocity of the electron beam as it leaves the reversing lens. The height of the elongate electrodes may be determined in accordance with the width of the space between the electrode array and the input surface of the electron multiplier; the width to height ratio lying between 1.0:1 and 2.0:1. In operation the elongate electrodes are energised in a sequence such that the electrostatic field shows a change progressing in a direction from the one end to the other end of the envelope.

If desired corrector plates may be disposed between the electron beam producing means and the deflecting means, for producing an electrostatic field having a component normal to the screen in order to adjust the path of the electron beam for any misalignment of the electron beam producing means.

The deflecting means deflects the electron beam over an are which is narrower than the width of the screen and the angular deflection of the beam is maintained after the electron beam has been deflected into the front portion by the reversing lens. By deflecting the beam over a narrow angle rather than a wide one as is done in some examples of the prior art then deflection aberrations are reduced or avoided altogether.

If desired the means for producing a low energy electron beam may comprise an astigmatic electron gun.

BRIEF DESCRIPTION OF THE DRAWINGS

The present invention will now be described, by way of example, with reference to the accompanying drawings, wherein.

DESCRIPTION OF THE PREFERRED EMBODIMENTS

Figure 2:
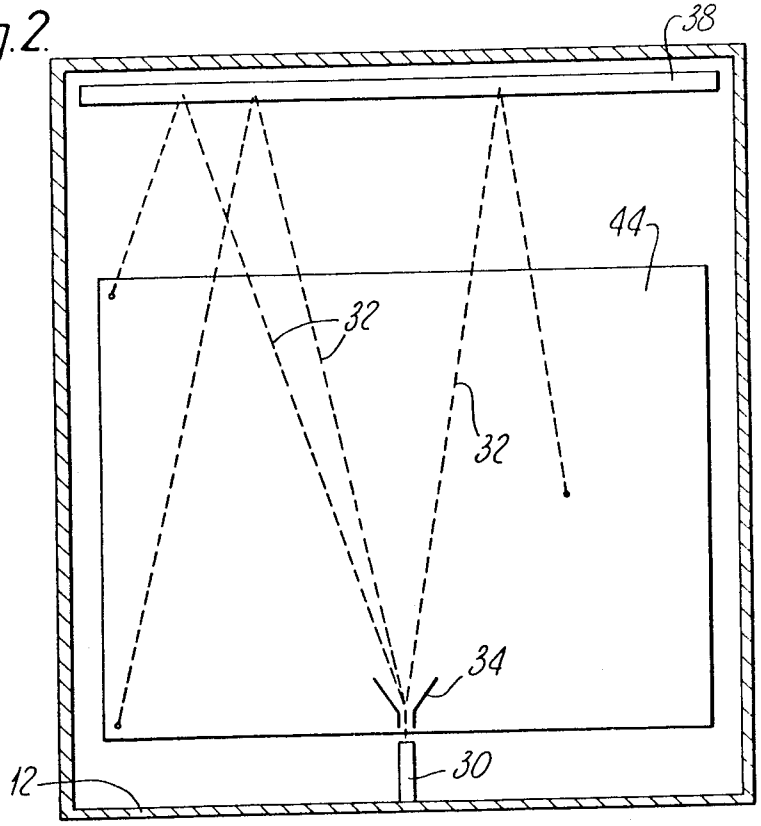
FIG. 2 is a diagram illustrating in broken lines three electron beam paths from the line deflector to an input side of a laminated dynode electron multiplier.

In the drawings corresponding reference numerals have been used to refer to the same parts.

The flat display tube 10 comprises an envelope 12 including an optically transparent, planar faceplate 14. On the inside of the faceplate 14 is a phosphor screen 16 with a post deflection acceleration (PDA) electrode 18 thereon.

For convenience of description, the interior of the envelope 12 is divided in a plane parallel to the faceplate 14 by an internal partition or divider 20 to form a front portion 22 and a rear portion 24. The divider 20, which comprises an insulator such as glass extends for substantially a major part of the height of the envelope 12. A planar electrode 26 is provided on a rear side of the divider 20. The electrode 26 extends over the exposed edge of the divider 20 and continues for a short distance down its front side. Another electrode 28 is provided on the inside surface of a rear wall of the envelope 12.

Means 30 for producing an upwardly directed electron beam 32 is provided in the rear portion 24 adjacent a lower edge of the envelope 12. The means 30 may be an electron gun of the hot or cold cathode type. An upwardly directed electrostatic line deflector 34 is spaced by a short distance from the final anode of the electron beam producing means 30 and is arranged substantially coaxially thereof. If desired the line deflector 34 may be electromagnetic.

At the upper end of the interior of the envelope 12 there is provided a reversing lens 36 comprising an inverted trough-like electrode 38 which is spaced above and disposed symmetrically with respect to the upper edge of the divider 20. By maintaining a potential difference between the electrodes 26 and 38 the electron beam 32 is reversed in direction whilst continuing along the same angular path from the line deflector 34 (see FIG. 2).

On the front side of the divider 20 there are provided a plurality of laterally elongate, vertically spaced electrodes of which the uppermost electrode 40 may be narrower and acts as a correction electrode as will be described later (see FIG. 3). The other electrodes 42 are selectively energised to provide frame deflection of the electron beam 32 onto the input surface of a laminated dynode electron multiplier 44. The laminated dynode electron multiplier 44 and its operation is described in a number of published patent specifications of which British Patent Specifications Nos. 1,401,969, 1,434,053 and 2,023,332A are but a few examples. Accordingly the details of the electron multiplier 44 will not be described in detail. However for those not familiar with this type of electron multiplier it comprises a stack of spaced apart, apertured mild steel plates held at progressively higher voltages. The apertures in the plates are aligned and contain a secondary emitting material. An electron striking the wall of an aperture in a first dynode produces a number of secondary electrons, each of which on impacting with the wall of an aperture in a second dynode produces more secondary electrons, and so on. The stream of electrons leaving the final dynode are accelerated towards the screen 16 by an accelerating field being maintained between the output of the electron multiplier 44 and the post deflection acceleration electrode 18.

In the operation of the display tube the following typical voltages are applied reference being made to 0 V, the cathode potential of the electron gun 30. The electrodes 26, 28 in the rear portion 24 of the envelope 12 are at 400 V to define a field free space in which line deflection takes place with potential changes of about ±50 V applied to the line deflectors 34. As the angular deflection of the electron beam continues after a reflection of 180° in the reversing lens 36 then the maximum angles need only be about ±20°. The trough-like electrode 38 of the reversing lens is at OV compared to the 400 V of the extension of the electrode 26 over the top edge of the divider 20. The input surface of the electron multiplier 44 is at 400 V whilst at the beginning of each frame scan the electrodes 42 are at 0 V but are brought up to 400 V in a sequence to be described so that the electron beam 32 in the front portion 22 is initially deflected into the topmost apertures of the electron multiplier 44, subsequently the electrodes 42 are brought up to 400 V to form a field free space with the electron multiplier 44 and the electron beam is deflected towards the electron multiplier 44 in the vicinity of the next electrode 42 in the group to be at 0 V. The landing angles $\theta$ of the electron beam 32 are fairly constant over the input side of the electron multiplier, these angles being between 30° and 40°. The voltage across each dynode of the electron multiplier 44 is typically +300 V per stage although the precise voltage depends on the secondary emitter used and could be as high as 500 V. Thus for a 10 dynode multiplier the total potential difference is 3.0 kV which, allowing for the 400 V on the input side of the multiplier, means that the potential at the output side is equal to 3.4 kV. The PDA electrode 18 is typically at a potential of 11 kV to form an accelerating field between the output side of the electron multiplier 44 and the screen 16.

In order to be able to carry out a rectangular raster scan across the input side of the electron multiplier 44 it is necessary to apply a trapezium correction to the line scan so that the electron beam 32 can follow say the vertical edge of the electron multiplier as shown in the left hand half of FIG. 2. The trapezium correction is applied dynamically to the line deflector 34 to reduce the acute angle that the electron beam 32 makes with the vertical as the electron beam progresses line by line in the frame direction. In the case of a 10 inch (25 cm) diagonal screen the maximum scan angles for the top and bottom of the screen are ±20° and ±13°, respectively.

Figure 4:
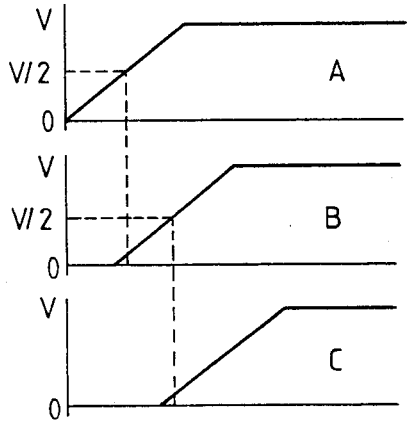
FIG. 4 illustrates waveforms of the voltages applied to successive frame deflection electrodes.

Referring to FIG. 4, the timing of the commencement of energisation of the electrodes 42 is chosen to suit the tube and its application. However for a television raster, experimental work so far suggests that a suitable timing cycle is to commence with the first electrode 42 at V/2 (200 V in the present example) and the second electrode 42 at 0 volts. Both electrodes are then energised so that their voltages increase linearly with time—see curves A and B. As curve A reaches V and curve B reaches V/2 then the next electrode 42 commences its energisation—see curve C. In consequence for the frame scan the potentials of two adjacent electrodes contribute to the electrostatic field. To obtain a linear scan with this form of energisation, it has been found desirable for the ratio of the width of the space 22 to the height of the electrodes 42 to lie in a range of between 1.0:1 and 2.0:1. If with the conditions chosen sufficiently good linearity is not obtained then some other means must be used. For example the voltages on three adjacent electrodes can be varied in a linear manner. Alternatively shaping of the waveforms may be carried out. As is evident from the foregoing description the line and frame scans are purely for the purposes of addressing the electron beam to the input side of the electron multiplier 44. Consequently the primary beam current can be small, typically 1 μA. However in order to obtain a good cross sectional shape for the incident beam an astigmatic electron gun 30 can be provided to complement the different horizontal and vertical focusing. In the case of a 10 inch (25 cm) display tube no dynamic focusing corrections are needed but this may not always be true for larger sizes of display tubes.

The mean brightness of the display on the screen 16 is controlled by the gain of the channel plate electron multiplier 44 and the potential on the final viewing screen. By this means the problems of the space charge effects on a low energy beam are avoided. Consequently the brightness can be made very high without any adverse effect on the spot size. Local brightness variations in response to an applied signal are effected on the grid of the electron gun.

Figure 1:
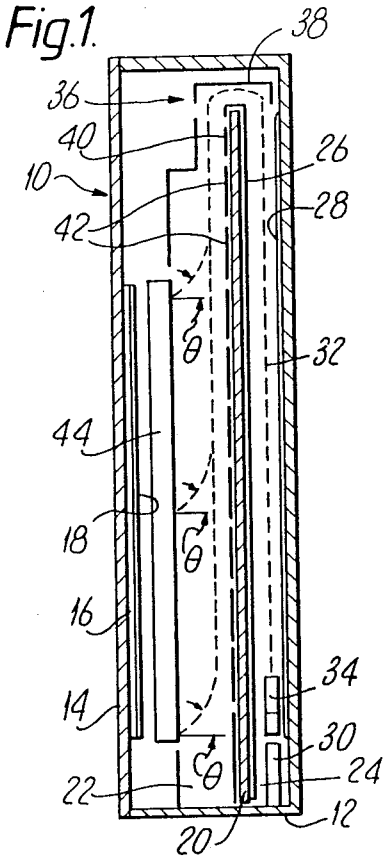
FIG. 1 is a diagrammatic cross section through an embodiment of the present invention.
Figure 3:
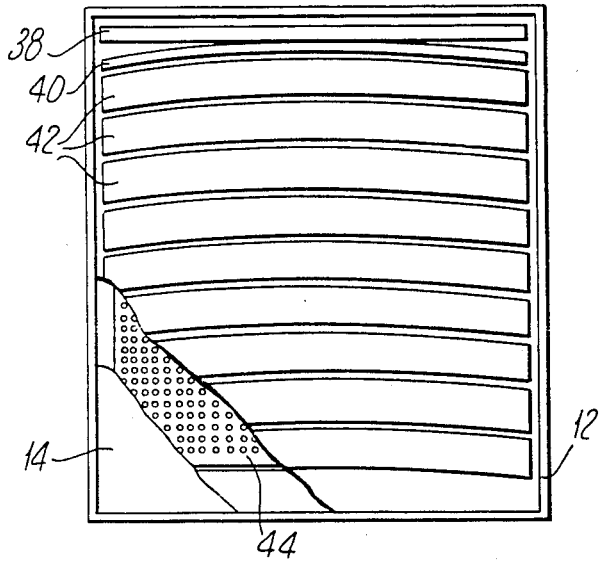
FIG. 3 is a diagrammatic view of the display tube with the faceplate and electron multiplier broken away to show the frame deflection electrodes.

Referring to FIGS. 1 and 3, other points to note in the illustrated display tube are that the trough-like reflector electrode 38 comprises flat surfaces with square or slightly rounded corners in order to obtain the desired lens field. Additionally the electrode 38 should be positioned symmetrically with respect to the divider 20 and at a suitable distance therefrom so that the beam having been deflected through 180° remains substantially parallel in the front region. This distance should be about 0.75 of the width of the rear region. However, as a precaution against misalignment of the electrode 38 which would lead to the beam 32 not being central or not emerging parallel to the plane of the screen the correction electrode 40 is provided and a correction voltage is applied. In the case of the illustrated tube having a 10 inch (25 cm) diagonal display, to correct for ±1 mm shift of the trough electrode normal to the electron multiplier 44 would require a correction voltage of about ±60 60 volts to be applied to the electrode 40. Similarly if the internal partition 20 is off-centre by up to ±1 mm then the effect of this can be corrected by a voltage of about ±35 volts on the correction electrode 40.

In order to counter the effect that the followed by the line scanned electron beam is slightly bowed rather than straight after the 180° reflection by the reversing lens 36, the electrodes 42 are slightly bowed in the opposite direction. The bowing of the line is due at least in part to the electron beam being slower in its forward direction as it leaves the reversing lens so that it is more readily turned over and strikes the electron multiplier 44 sooner, particularly at the edges. The degree of curvature of the electrodes 42 has been exaggerated in FIG. 3 but for say a 10 inch (25 cm) diagonal display tube the curvature of the upper edge is such that there is about 3 mm difference between the centre and the ends and for the lower edge this difference is about 2 mm.

Other refinements which may be incorporated into the display tube but which are not shown in the drawings include corrector plates for deflecting the path of the electron beam in a plane perpendicular to the screen as it leaves the electron beam producing means 30 but before it reaches the line deflector 34 in order to counter any misalignment of the electron beam producing means 30. One or more feeler electrodes may be provided on the rear side of the divider 20 to sense the position of the electron beam 32 as it scans arcuately across the electrode 38. In consequence any positional error in the scan can be sensed and appropriate correcting voltages applied to the corrector plates. This will ensure that the beam always enters the central part of the reversing lens.

In the embodiment shown in the drawings, the electron beam producing means 30 and line deflector 34 have been shown disposed at the lower end of the envelope 12 and the reversing lens 36 at the top end of the envelope 12. However in an alternative, non-illustrated embodiment the beam producing means 30 and the line deflector 34 can be arranged at the top end of the envelope 12 with the reversing lens at the bottom end. In order to carry out from deflection it is necessary at the commencement of each scan to have all the electrodes 42 at 400 V to provide a field free space between them and the electron multiplier 44 and then to bring each electrode 42 in turn down to zero volts commencing at the top to deflect the electron beam 32 onto the input of the electron multiplier 44.

In constructing the tube envelope the faceplate 14 is of a flat, toughened glass whilst the remainder of the envelope 12 can be of glass or metal. Known glass to glass and glass to metal seals can be used for sealing the two parts together in a vacuum tight fashion. For a 10 to 13 inch (25 to 32.5 cm) diagonal tube the total thickness could be of the order of 5 to 6 cm. Furthermore since all the scan deflections take place at low voltage the power required to drive such a tube is quite low, about 5 watts.

An advantage of having the electron multiplier 44 separating the addressing part of the tube and the visible display part of the tube is that alterations to the performance of one part does not generally affect the other part which provides a degree of freedom not available to the designers of the display tubes mentioned in the preamble of the specification. This extra degree of freedom is useful when it comes to colour selection. Two techniques which are considered possible are disclosed in British Patent Specifications Nos. 1,446,774 and 1,452,554 details of which are incorporated by way of reference and a further technique providing a limited range of colours is to use a "penetron" type screen which comprises 2 or 3 layers of phosphors each of which luminesces in response to different energies of the electron beam when accelerated from the electron multiplier 44.

In an alternative, non-illustrated embodiment of the invention the channel plate electron multiplier 44 is made of glass. Such a multiplier is suitable for use in display tubes having a screen size of the order of 100 mm by 75 mm.

We claim:

1. A display tube comprising an envelope containing:

(a) a partition for dividing the envelope into a front envelope portion and a rear envelope portion;

(b) a luminescent screen disposed on an inner surface of the envelope in the front envelope portion;

(c) an electron gun in the rear envelope portion for producing an electron beam directed along the length of the rear envelope portion past one end of the partition;

(d) deflection electrode means arranged in the rear envelope portion for transversely deflecting the electron beam over a range of deflection angles;

(e) reversing electrode means disposed opposite said one end of the partition and configured to produce an electric field for bending the electron beam around said one end of the partition and directing it along the length of the front envelope portion; and (f) an electrode array arranged on the partition, in the front envelope portion, for selectively deflecting the electron beam toward the luminescent screen at any one of a multiplicity of raster scan lines extending transversely to the length of the front envelope portion;

characterized in that:

(1) the electron gun is configured to produce a low energy electron beam;

(2) the deflection electrode means and the reversing electrode means are configured to produce respective deflection and reversing electric fields for deflecting and bending the electron beam along a path which has substantially the same deflection angle in both the front envelope portion and the rear envelope portion;

(3) an electron multiplier is disposed between the partition and the luminescent screen, said electron multiplier comprising an input side, an output side, and a multiplicity of electron-multiplying channels extending therebetween for multiplying the number of electrons in the beam deflected by the electrode array before it reaches said luminescent screen, said input side cooperating with the electrode array to define a deflection field for effecting said selective deflection of the electron beam; and (4) An accelerating electrode is disposed on the luminescent screen for defining, between said luminescent screen and the output side of the electron multiplier, an accelerating electric field for accelerating to an increased energy level the electrons leaving said multiplier before they impact said luminescent screen; said electron multiplier electrically isolating from each other the deflection and accelerating fields defined on opposite sides thereof and enabling said deflection and accelerating functions to be controlled independently.

2. A display tube as in claim 1 where the electron multiplier comprises a channel plate multiplier formed by a laminated stack of dynodes.

3. A display tube as in claim 1 where the reversing electrode means comprises a repeller electrode mounted at one end of the envelope and a cooperating electrode on the partition.

4. A display tube as in claim 3 where the repeller electrode comprises a channel-shaped member having substantially flat sides.

5. A display tube as in claim 1 including a correcting electrode disposed on the partition in the front envelope portion adjacent said one end of the partition for correcting asymmetry in a reversing electrostatic lens produced by the reversing electrode means.

6. A display tube as in claim 1 where the electrode array comprises a plurality of elongate electrodes arranged on the partition in a direction transverse to the path of the electron beam.

7. A display tube as in claim 6 where the elongate electrodes are bowed by an amount sufficient to counteract the effect of a variation in the forward component of the electron beam velocity as it leaves the electric field produced by the reversing electrode means.

8. A display tube as in claim 6 or 7 where the ratio of the distance between each of the elongate electrodes and the electron multiplier to the dimension of the electrode along the path of the electron beam is between 1.0:1 and 2.0:1.

9. A display tube as in claim 6 including means for sequentially energizing the elongate electrodes to produce a predefined electrostatic field pattern which moves progressively along the length of the front envelope portion.

10. A display tube as in claim 1 including corrector plates disposed between the electron gun and the deflection electrode means for producing an electric field having a component normal to the screen for adjusting the path of the electron beam for any misalignment of the electron gun.

11. A display tube as in claim 1 where the electron gun is configured to produce an astigmatically-focussed electron beam.

12. A display tube as in claim 1 where the electron multiplier includes color selection means.

13. A display tube as in claim 1 where said electron gun produces an electron beam having an energy smaller than 1 Kev.

* * * * *